United States Patent [19]

Barber

[11] 4,286,787

[45] Sep. 1, 1981

[54] FOUR PLAYER BACKGAMMON

[75] Inventor: Herbert L. Barber, Liverpool, N.Y.

[73] Assignee: Double Backgammon Enterprises, Inc., Newport, R.I.

[21] Appl. No.: 149,651

[22] Filed: May 12, 1980

[51] Int. Cl.[3] ..... A63F 3/00

[52] U.S. Cl. ..... 273/248

[58] Field of Search ..... 273/243, 248, 249, 256, 273/272, 274

[56] References Cited

U.S. PATENT DOCUMENTS

| | | | |
|---|---|---|---|
| D. 97,078 | 7/1935 | Lord | 273/248 |
| D. 241,048 | 8/1976 | Zemby | 273/248 |
| 2,495,007 | 1/1950 | Howard | 273/243 |
| 2,722,425 | 11/1955 | Gazelle | 273/248 |
| 4,058,318 | 11/1977 | Thomas | 273/248 |
| 4,058,319 | 11/1977 | Thomas | 273/248 |

FOREIGN PATENT DOCUMENTS

| | | | |
|---|---|---|---|
| 722494 | 1/1931 | France | 273/248 |

*Primary Examiner*—Richard C. Pinkham
*Assistant Examiner*—Carl Moy
*Attorney, Agent, or Firm*—Salter & Michaelson

[57] ABSTRACT

A modified backgammon game permitting play by four players either competing individually against each other or as two-man teams against each other, comprising a game board consisting of three conventional backgammon sections as opposed to the conventional two sections, each player having his own set of playing pieces and having a starting point at a different corner of the board, each player moving his pieces pursuant to conventional backgammon rules through a path located in and extending through the adjacent outer section and the common center section.

5 Claims, 3 Drawing Figures

FOUR PLAYER BACKGAMMON

BACKGROUND AND SUMMARY OF THE INVENTION

It is thought that the conventional game of backgammon is one of the oldest games known to man. Although backgammon is thought to date back for approximately five thousand years, it is thought that the present form of the game evolved in approximately the Tenth Century. In 1743 the famous Edmund Hoyle codified the rules and strategy of the game and since that time, the only significant change that has taken place has been the addition of the doubling cube, which although adding to the excitement of the game, has not materially effected the actual game play.

As presently constituted, conventional backgammon is essentially a two-player game even though there are some variations of backgrammon that permit play by more than two people. For exmaple, in the game known as Chouette, a team of two or more players headed by a captain plays against a solitary opponent on a standard backgammon board. Duo-gammon is a variation of Chouette in which two-man teams play against each other on a standard backgammon board. Each person on a team takes alternate turns in moving the same set of playing pieces. There is also a game known as Quadragammon but this game completely changes the format of the standard backgammon board thus losing the benefits derived from familiarity of moves on a standard backgammon board. Also, in this game there is an entirely different setup for the playing pieces when playing partners, as opposed to individual play.

None of the above-described games permit total individual play by each player in a generally standard backgammon format and hence it has been found desirable to provide a modified form of backgammon wherein the same basic playing board is utilized and wherein the standard rules of conventional backgammon are generally followed, but which at the same time permits four players to partake in the game, either competing against each other individually or competing as two-man teams, and wherein each player has total individual control over his own playing pieces. This is accomplished by providing a game board comprising three sections rather than the conventional two sections which exist in the standard backgammon board. Each of the three sections in the game board of the present invention is identical in all respects to the design and arrangement of the current conventional two-sectioned board whereby either of the outermost sections of the novel board of the present invention, when taken in combination with the center section, actually simulates the current two-section board.

Each player is provided with a set of playing pieces visually distinguishable from the playing pieces of the other players so that with each player starting from a different corner of the game board, the players are initially arranged in conventional backgammon fashion, i.e. the arrangement of playing pieces on the outer sections will identically duplicate the arrangement of playing pieces in conventional backgammon, whereas the center section will have twice as many playing pieces positioned therein as would otherwise be the case. Following the general rules of conventional backgammon, each player moves his pieces through the adjacent outer section and the center section, i.e. each player actually only uses two of the three sections, with one pair of players using one of the outer sections and the common center section, and the other pair of players using the other outer section and the common center section. Thus the present invention provides a variation of conventional backgammon wherein the game board, although modified as above indicated, retains the same format as the standard backgammon board and wherein the playing pieces move through the same number of spaces as in conventional backgammon, while utilizing most of the standard moves thereof. The present invention permits four people to play backgammon either competing individually or against each other or as partners, and in either case, each player has his own set of playing pieces over which he exercises complete individual control. When played in the partnership format, the present invention permits each player to cooperate with and assist his partner thus enhancing the overall excitement and strategy of the game.

Other objects, features and advantages of the invention shall become apparent as the description thereof proceeds when considered in connection with the accompanying illustrative drawing.

DESCRIPTION OF THE DRAWING

In the drawing which illustrates the best mode presently contemplated for carrying out the present invention.

DESCRIPTION OF THE INVENTION

Figure 1:
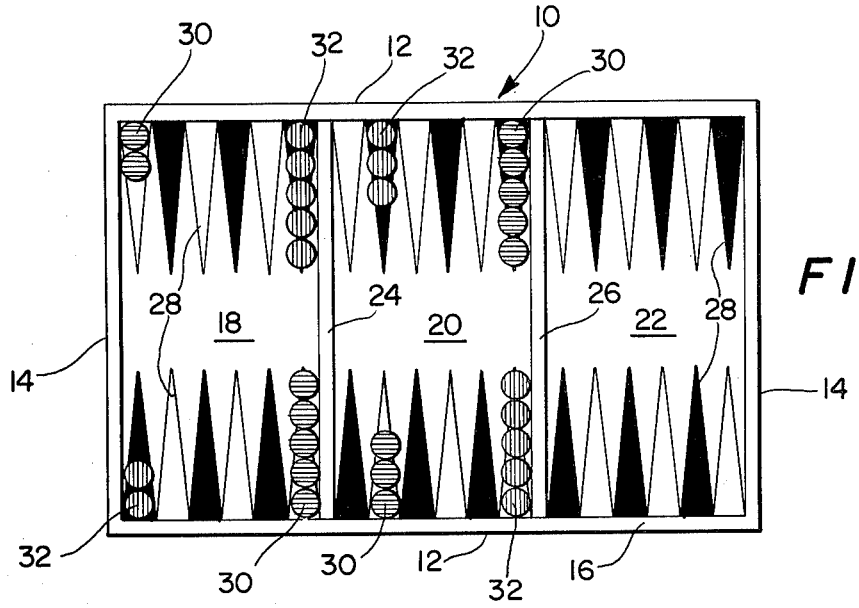
FIG. 1 shows the game board of the present invention with playing pieces conventionally arranged on one of the outer sections and the common center section in the same manner as in conventional two-player backgammon.

Referring to FIG. 1, there is shown generally at 10 a backgammon game board construction in accordance with the instant invention. As will be noted, game board 10 is of generally rectangular configuration having opposed longitudinal edges 12 connected at their opposite extremities by shorter end edges 14. A marginal border 16 may be provided around the periphery of board 10 and it will be noted that the board 10 is divided into three substantially equal sections 18, 20 and 22 by virtue of transverse bar portions 24, 26 which extend between opposite longitudinal edges 12. If desired, hinge means (not shown) may be provided adjacent the bar portions 24, 26 to enable the board 10 to be folded upon itself for more convenient carrying and storage.

It will be understood that each of the sections 18, 20 and 22 comprise an identical design and arrangement to that characterized by conventional backgammon playing sections now being used. More specifically, each section comprises six inwardly extending points 28 extending from opposite edges 12 of the game board whereupon each section comprises a total of 12 points. As will be noted, the points of each section are alternately colored and oppositely aligned points in each section are likewise alternately colored.

Still referring to FIG. 1, it will be seen that two sets of playing pieces 30, 32 are positioned in the sections 18 and 20 in conventional fashion, i.e. the sections 18 and 20 with the playing pieces 30 and 32 positioned thereon, as illustrated, identically duplicate the conventional existing two-sectioned backgammon board with the conventional initial positioning of playing pieces thereon. Thus, two persons could engage each other in a completely conventional game of backgammon using only the sections 18 and 20, with one player controlling movement of the playing pieces 30 and the other player controlling movement of the playing pieces 32, all in a conventional manner and following the present rules of backgammon. In the play of such a game, the section 22 would not be used at all.

It is important to note that playing pieces 30 and 32 are visually distinguishable from each other by any suitable means, such as being of a different color although other means of visual distinguishment could be used.

Figure 2:
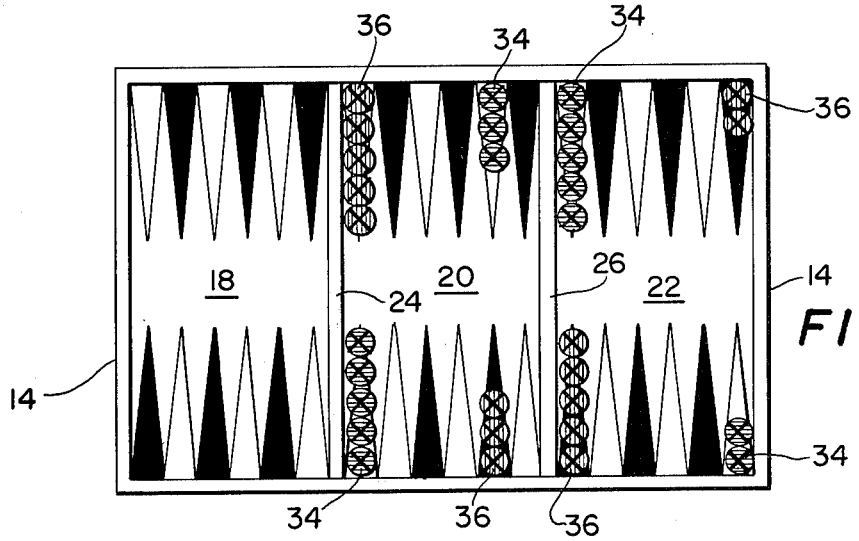
FIG. 2 is a view similar to FIG. 1 showing the game board with playing pieces conventionally arranged on the other outer section and the common center section, as in conventional two-man backgammon.

Referring now to FIG. 2, it will be seen that FIG. 2 is actually a duplication of FIG. 1 except that the two sets of playing pieces 34, 36 are now positioned in sections 20 and 22 whereupon a completely conventional game of backgammon could be played utilizing only these two sections.

Figure 3:
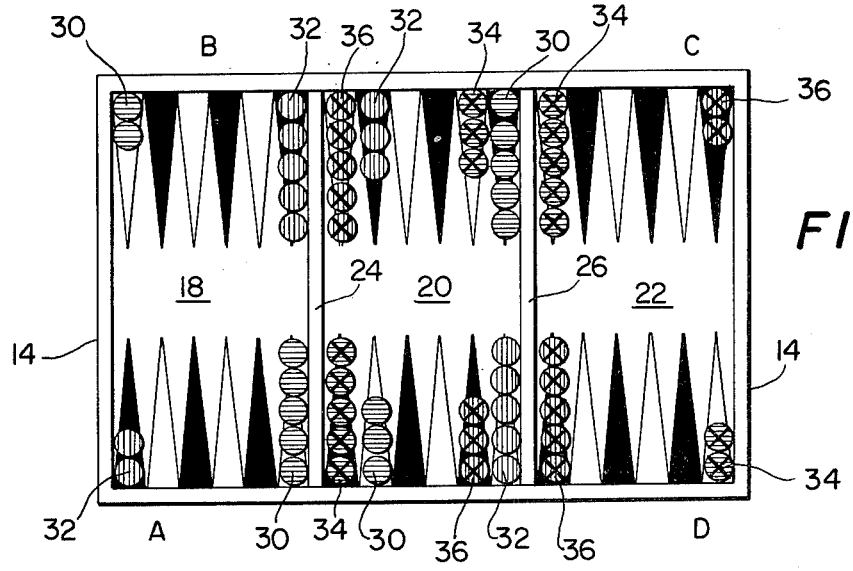
FIG. 3 shows the game board of FIGS. 1 and 2 with playing pieces arranged thereon in their initial position where the game is to be played with four players.

FIG. 3 shows the game board 10 set up for play with four persons, it being apparent that the playing pieces 30, 32, 34 and 36 are positioned on the board 10 in precisely the same positions as illustrated in FIGS. 1 and 2. Assuming that player A is controlling movement of the playing pieces 30; player B is controlling the pieces 32; player C is controlling the pieces 34; and player D is controlling the pieces 36, it will be understood that the players will sit or otherwise position themselves at the corresponding areas identified by the letters A, B, C and D in FIG. 3. Thus, players A and B will only use sections 18 and 20 during the play of the game, while players C and D will only use sections 20 and 22. If the players are competing against each other individually, then all rules of conventional backgammon will be followed; it being understood that if a playing piece is "hit", it will be positioned at the bar portion nearest its respective player, i.e. playing pieces 30 and 32 be positioned on bar portion 24 while playing pieces 34 and 36 would be positioned on bar portion 26. The first player "bearing off" all of his men or playing pieces would be the winner of the game.

Where the game is to be played in a partnership format, each pair of partners would sit at diagonally opposite corners of the board, i.e. in FIG. 3, A and C would be partners while B and D would be partners. Note that although the playing pieces 32 and 36, as well as the playing pieces 30 and 34, are visually distinguishable, as by the affixing of cross lines thereover, they do have a common visual characteristic, such as being the same color. This permits playing pieces of one team to be visually distinguished from those of the opposing team, while at the same time permitting the playing pieces of one partner to be visually distinguishable from those of his partner, as is obviously necessary to permit each player to control movement of his own individual men or playing pieces. In the play of the partnership game, all basic rules of backgammon are followed, except that a player does not "block" or "hit" the playing pieces of his partner. Quite to the contrary, partners may cooperate with each other to effect a "block" on a given point in the section 20 thus enhancing the skill and strategy of the partnership game. The game is won when both partners of one team have finished "bearing off" all of their men. When one partner has finished "bearing off" all of his men, the remaining partner assumes his turn, it being understood that otherwise the individual players all move in sequence, whether playing against each other individually or as teams.

As previously emphasized, all of the basic rules of conventional backgammon are utilized during the play of the instant invention, reference being made to "hitting", "blocking", placing a man that has been "hit" on the "bar", use of the large doubling cube, "bearing off" procedure etc. It will be apparent, however, that provision of the three-sectioned board, as opposed to the conventional two-sectioned board, permits four people to play the game, either individually or as partners, with each player having his own playing pieces and maintaining complete control over the movement thereof.

When the four players compete against each other individually, four small doubling cubes are used, one for each player, in addition to the covnentional large doubling cube. Specifically, the large doubling cube is used to designate which player has the option to double or redouble, and the highest wager offered. The small doubling cubes are used to designate the level of each individual players's wager.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is

1. A backgammon game adapted to be played by four persons competing against each other either individually or as opposing two-man teams, said game comprising a generally rectangular playing board having opposed elongated edges connected at their extremities by shorter end edges, a pair of spaced bar portions extending between said opposed elongated edges and dividing said board into three substantially equal sections, each having conventional backgammon points marked thereon whereby the center section in combination with either outer section defines a conventional backgammon playing surface, said game further comprising four sets of playing pieces visually distinguishable from each other, two of said sets of playing pieces being arranged at the outset of game play on one of said outer sections and said center section in conventional backgammon arrangement, and the other two sets being arranged on the other of said outer sections and said center section in conventional backgammon arrangement.

2. In the game of claim 1, two of said sets of playing pieces having a common visual characteristic, whereby when the game is played by two-man teams, the partners on a given team use sets having the common visual characteristics.

3. In the game of claim 2, each pair of partners having starting points at opposite corners of said board, the playing pieces of each player moving in a conventional path through the adjacent outer section and the center section.

4. The game of claim 3 further characterized in that conventional backgammon rules are followed with the exception that a player does not "block" or "hit" his partner.

5. The game of claim 1 further characterized in that when the four players compete against each other individually, each player is provided with a small doubling cube, the game otherwise following conventional backgammon rules with each player moving his playing pieces through the outer section in which his pieces are initially positioned and through the common center section.

* * * * *